US006591961B2

(12) United States Patent
Fukushima

(10) Patent No.: US 6,591,961 B2
(45) Date of Patent: Jul. 15, 2003

(54) CARRYING SYSTEM

(75) Inventor: Masazumi Fukushima, Aichi (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/956,149

(22) Filed: Sep. 20, 2001

(65) Prior Publication Data

US 2002/0033319 A1 Mar. 21, 2002

(30) Foreign Application Priority Data

Sep. 21, 2000 (JP) ..... 2000-287154

(51) Int. Cl.[7] ..... B65G 37/00

(52) U.S. Cl. ..... 198/346.2; 198/346.1; 414/222.07

(58) Field of Search ..... 198/346.1, 346, 198/418, 346.2, 358; 414/222.07, 139.9, 140.1

(56) References Cited

U.S. PATENT DOCUMENTS

| | | | | | |
|---|---|---|---|---|---|
| 3,799,319 | A | * | 3/1974 | Cutler et al. | 198/29 |
| 3,834,315 | A | * | 9/1974 | Warner | 104/88 |
| 3,998,316 | A | * | 12/1976 | Damm | 198/344 |
| 4,140,213 | A | * | 2/1979 | Denison | 198/358 |
| 5,178,255 | A | * | 1/1993 | Carlson | 198/346.1 |
| 5,320,209 | A | * | 6/1994 | Del Monaco et al. | 198/370 |
| 5,402,875 | A | * | 4/1995 | Markin et al. | 198/346.1 |
| 5,575,375 | A | * | 11/1996 | Sandusky et al. | 198/358 |
| 5,884,392 | A | * | 3/1999 | Lafond | 29/722 |
| 5,937,994 | A | * | 8/1999 | De Barbuat | 198/346.2 |
| 5,976,199 | A | * | 11/1999 | Wu et al. | 29/25.01 |
| 6,044,957 | A | * | 4/2000 | Guttinger | 198/418.3 |
| 6,224,319 | B1 | * | 5/2001 | Velikov et al. | 414/44.5 |
| 6,240,335 | B1 | * | 5/2001 | Wehrung et al. | 700/230 |
| 6,264,550 | B1 | * | 7/2001 | Matsumoto | 454/187 |
| 6,308,818 | B1 | * | 10/2001 | Bonora et al. | 198/465.1 |
| 6,425,477 | B1 | * | 7/2002 | Karasawa | 198/575 |
| 6,435,330 | B1 | * | 8/2002 | Bonora et al. | 198/346.3 |
| 6,450,319 | B1 | * | 9/2002 | Reist | 198/358 |

FOREIGN PATENT DOCUMENTS

| | | |
|---|---|---|
| JP | 2000-53237 | 2/2000 |

* cited by examiner

*Primary Examiner*—Christopher P. Ellis
*Assistant Examiner*—Rashmi Sharma
(74) *Attorney, Agent, or Firm*—Armstrong, Westerman & Hattori, LLP

(57) ABSTRACT

With a rail which is used by both a linear conveyor vehicle and a track guided vehicle, the traveling loops 2,3, the short-cuts 4~7 and the access routes 8~11 are provided. The traveling loops 20~25 are arranged in a rail for a track guided vehicle, and are connected to the traveling loops 2,3 at the diverging/converging point 30. A linear conveyor vehicle system and a track guided vehicle system are integrated to convey articles efficiently.

2 Claims, 5 Drawing Sheets

CARRYING SYSTEM

FIELD OF THE INVENTION

The present invention relates to a carrying system used in a clean room etc.

BACKGROUND OF THE INVENTION

In case of carrying articles in a clean room etc., a low-speed track guided vehicle which is equipped with a transfer equipment is often used in an intrabay transportation, and an interbay transportation is often conducted by a high-speed linear conveyor vehicle which is not equipped with a transfer equipment. A track guided vehicle, using the exclusive rail, is operated as a track guided vehicle system. And likewise, a linear conveyor vehicle, using the rail that an exclusive linear motor is built, is operated as a linear conveyor vehicle system. In case of carrying articles from one process to another by use of these systems, a total of 4-time transfers are needed, and a transfer from the track guided vehicle to a stocker as a buffer, from the stocker to the linear conveyor vehicle, from the linear conveyor system to the stocker as the buffer, and from the stocker to the track guide vehicle.

It is the fundamental object of the present invention to improve a transferring efficiency by integrating an interbay transportation system and an intrabay transportation system.

It is an additional object of the present invention to make the conveyance of rush articles etc. easier and to convey articles quickly.

It is a further additional object of the present invention to make a diverging control easier.

SUMMARY OF THE INVENTION

A carrying system of the present invention makes a conveyor vehicle for an interbay transportation travel along a long-distance loop, and makes a conveyor vehicle for an intrabay transportation travel by laying a plurality of short-distance traveling routes for the intrabay transportation around the long-distance loop. The carrying system features that the short-distance traveling route is connected to the long-distance loop with a converging/diverging part, and the long-distance loop and the short distance traveling route are composed such that at least one conveyor vehicle for either the interbay or the intrabay transportation is capable of traveling both the long distance loop and the short-distance traveling routes.

It is preferable that a conveyor vehicle for the interbay transportation does not carry transfer equipment, and a conveyor vehicle for the intrabay transportation carries transfer equipment. Also, at least one aforementioned conveyor vehicle for either the interbay or the intrabay transportation, is used as the conveyor vehicle for the intrabay transportation.

More preferably, the means of controlling a diverging direction of a conveyor at the converging/diverging part, is provided with the vehicle for both the interbay and the intrabay transportation.

According to the present invention, the conveyance systems for the interbay and the intrabay transportation are connected to be used as one system. Due to this, for example, articles are possible to be sent directly without transferring from the short-distance traveling route for the intrabay transportation to the next traveling line for the intrabay transportation by way of the long-distance loop for the interbay transportation.

According to the present invention, rush articles can be sent directly between processes by use of the conveyor vehicle for the intrabay transportation, or articles can be sent directly to the next process by way of the long-distance loop, in case that the traveling distance in the long-distance loop to the next process is short, and the like. As the conveyor vehicle for the intrabay transportation is equipped with the transfer equipment, articles can be sent directly and transferred from the intrabay processing equipment to the other intrabay processing equipment. Moreover, as a conveyor vehicle which is not equipped with the transfer equipment is provided for the interbay transportation, articles can be conveyed at high speed among small number of stations which is equipped with the transfer equipment in a vehicle for interbay transportation.

The present invention produces a plurality of converging/diverging parts. According to the present invention, as control devices in the diverging direction, which are provided in the conveyor vehicle for both the intrabay and the interbay transportation, diverge at these converging/diverging parts, the diverging control becomes easier.

DETAILED DESCRIPTION OF THE PREFERRED EMBODIMENTS

FIGS. 1~5 show an embodiment, by taking a conveyance system which a linear conveyor vehicle system and a track guided vehicle system are integrated for example.

Figure 1:
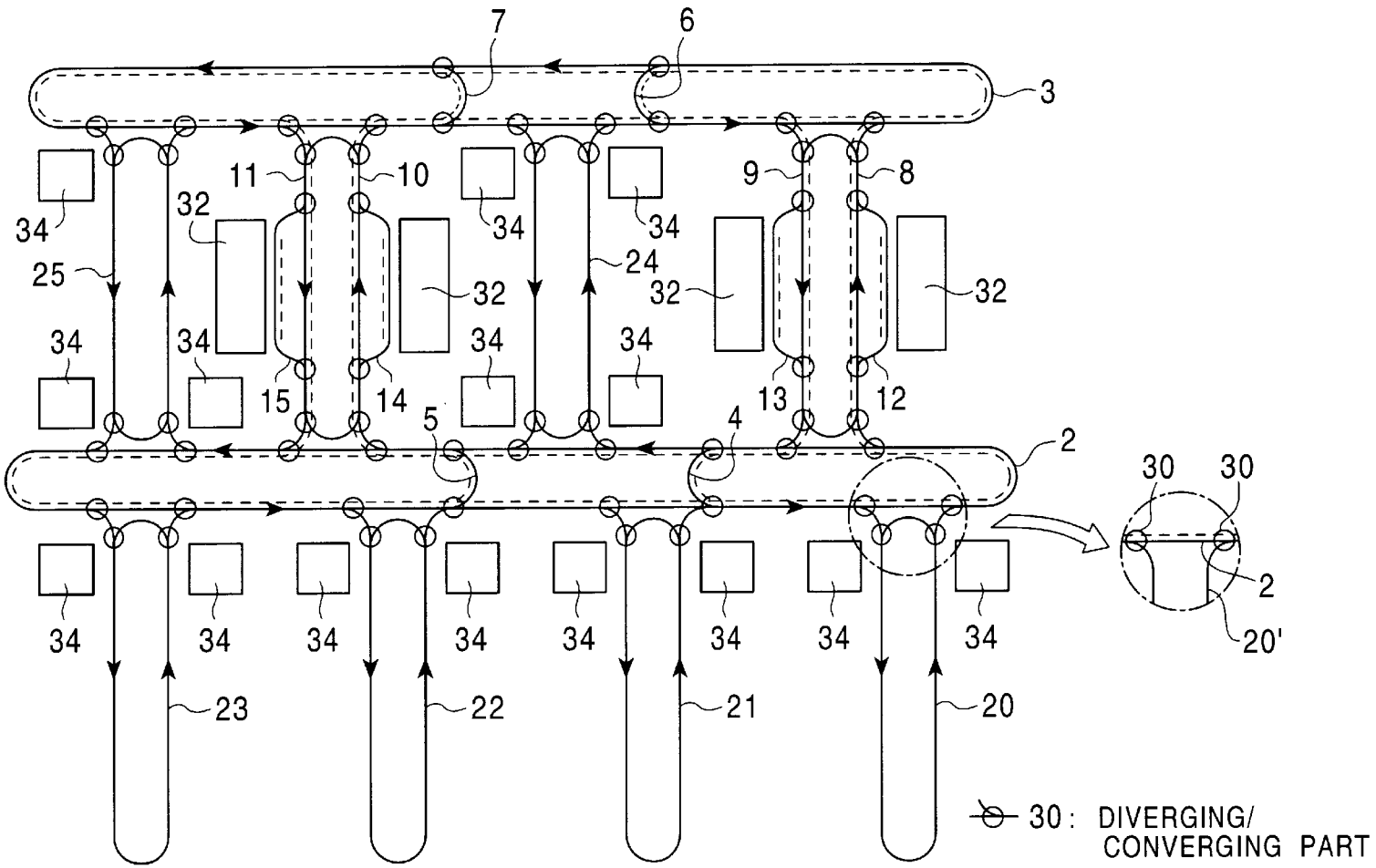
FIG. 1 is a top view showing a layout of carrying system according to an embodiment of the present invention.

As shown in FIG. 1, traveling loops 2,3 are provided as long-distance loops for an interbay transportation. Both are one-way loops to a direction indicated by arrows shown in FIG. 1. Short-cuts 4~7 are provided in the traveling loops 2,3, and access routes 8~11 are arranged in order to connect the traveling loops 2,3. Sidings 12~15 are provided along the access routes 8~11 etc., for transferring articles to and from a stocker and overtaking, and the like. Moreover, other sidings are possible to be provided in the traveling loops 2,3 as well. Shared rails of a linear conveyor vehicle and a track guided vehicle are laid on the traveling loops 2,3, the short-cuts 4~7, the access routes 8~11 and the sidings 12~15. FIG. 1 shows shared interval of the linear conveyor vehicles and the track guided vehicles by overlapping a solid line and a broken line.

Traveling loops 20~25 are provided exclusively for the track guided vehicles for the intrabay transportation. The traveling loops 20~23 are connected to the traveling loop 2, and the traveling loops 24,25 are connected to the both traveling loops 2,3. In this area, the traveling loops 20~25 are composed in a loop shape in order for the track guided vehicles to go around the traveling loops 20~25 without passing the traveling loops 2,3. However, like the both way line 20' which is shown on the right side of FIG. 1, it is possible that the track guided vehicles do not go around the loop but travel back and forth on the both way line 20' connected to the traveling loops 2,3. The converging/diverging part 30 is provided in the terminal area, meeting the traveling loops 2,3 and the traveling loops 20~25, the short-cuts 4~7 and the access routes 8~11, and the other terminal area of the access routes 8~11 and the sidings 12~15 and so on. The composition of the converging/diverging part 30 is described hereafter with reference to FIG. 4 and FIG. 5.

A conveyance work of linear conveyor vehicles is to carry articles between stockers. A transfer equipment equipped with a freely extending arm for the linear conveyor vehicle is installed in a stocker, and the linear conveyor vehicle itself is not loaded with the transfer equipment. Due to this, the linear conveyor vehicle conveys articles at high speed among the limited stations, and it is suitable for the long-distance interbay transportation. As the track guided vehicle has transfer equipment, for example the freely elevatable chuck, the articles are not only conveyed from processing equipment to another in a process, but also transferred to and from the stocker. Due to this, the stations for the linear conveyor vehicles and for the track guided vehicles are provided separately in each stocker, for example. In the embodiment, a comparatively large-sized stocker 32 is placed along the access routes 8 11 of the traveling loops 2,3, and a comparatively small-sized stocker 34 is placed near the inlet and the outlet of each process. The stations for the linear conveyor vehicle and for track guided vehicles are provided in these stockers 32,34, and the transfer equipment not shown in the drawings is provided in the station for linear conveyer vehicles.

FIG. 1 shows that the linear conveyor vehicles and the track guided vehicles travel along the common traveling loops 2,3. Like the linear conveyer vehicle for the intrabay transportation which is equipped with the transfer equipment, and the linear conveyor vehicle for long-distance and high speed transportation which is not equipped with the transfer equipment and the like, two kinds of conveyor vehicles that the kinds of motor and the structure of a vehicle is common, are possible to travel on the same rail.

Figure 2:
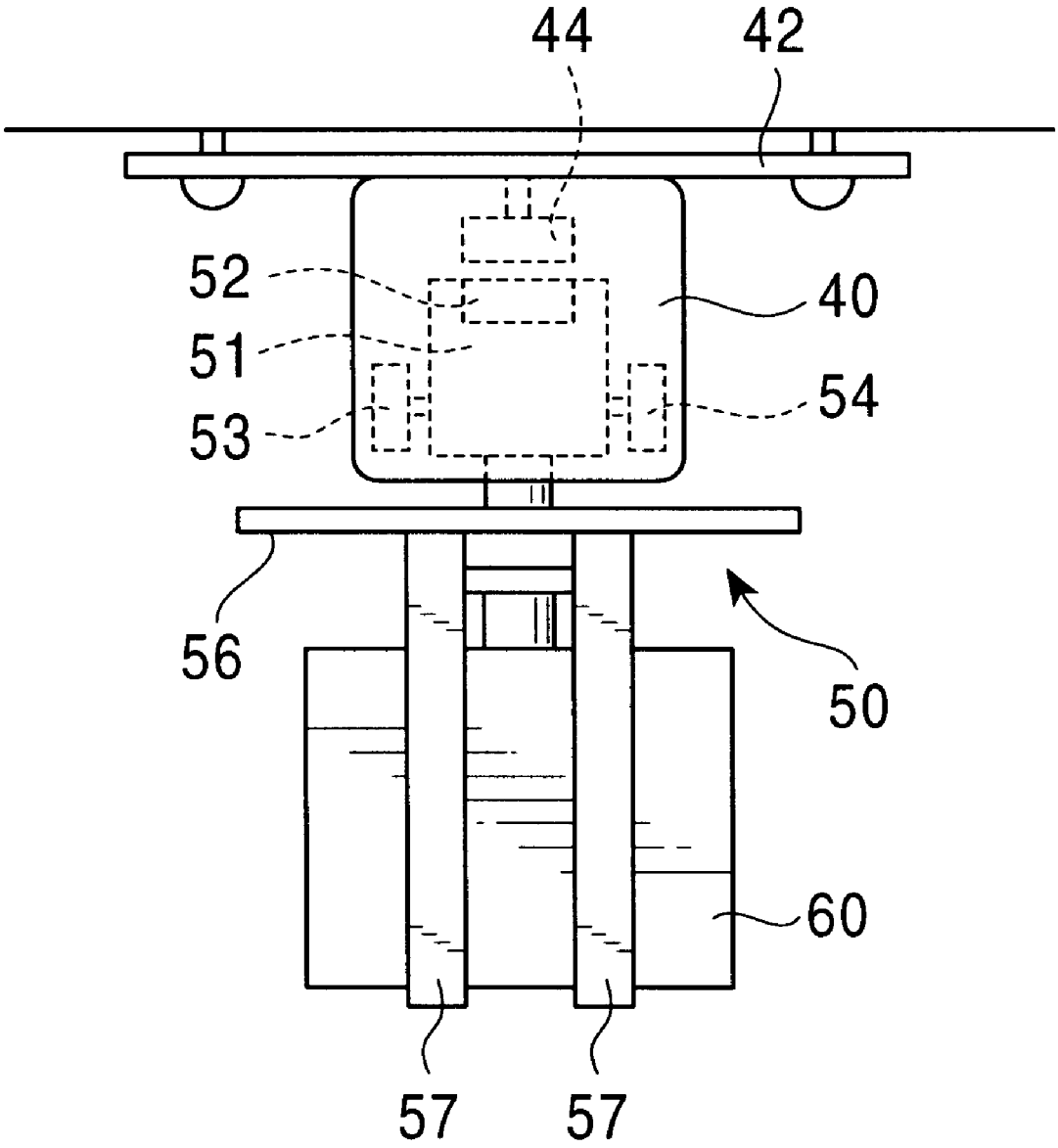
FIG. 2 is a front view showing a linear conveyor vehicle in motion on a rail according to an embodiment of the present invention.
Figure 3:
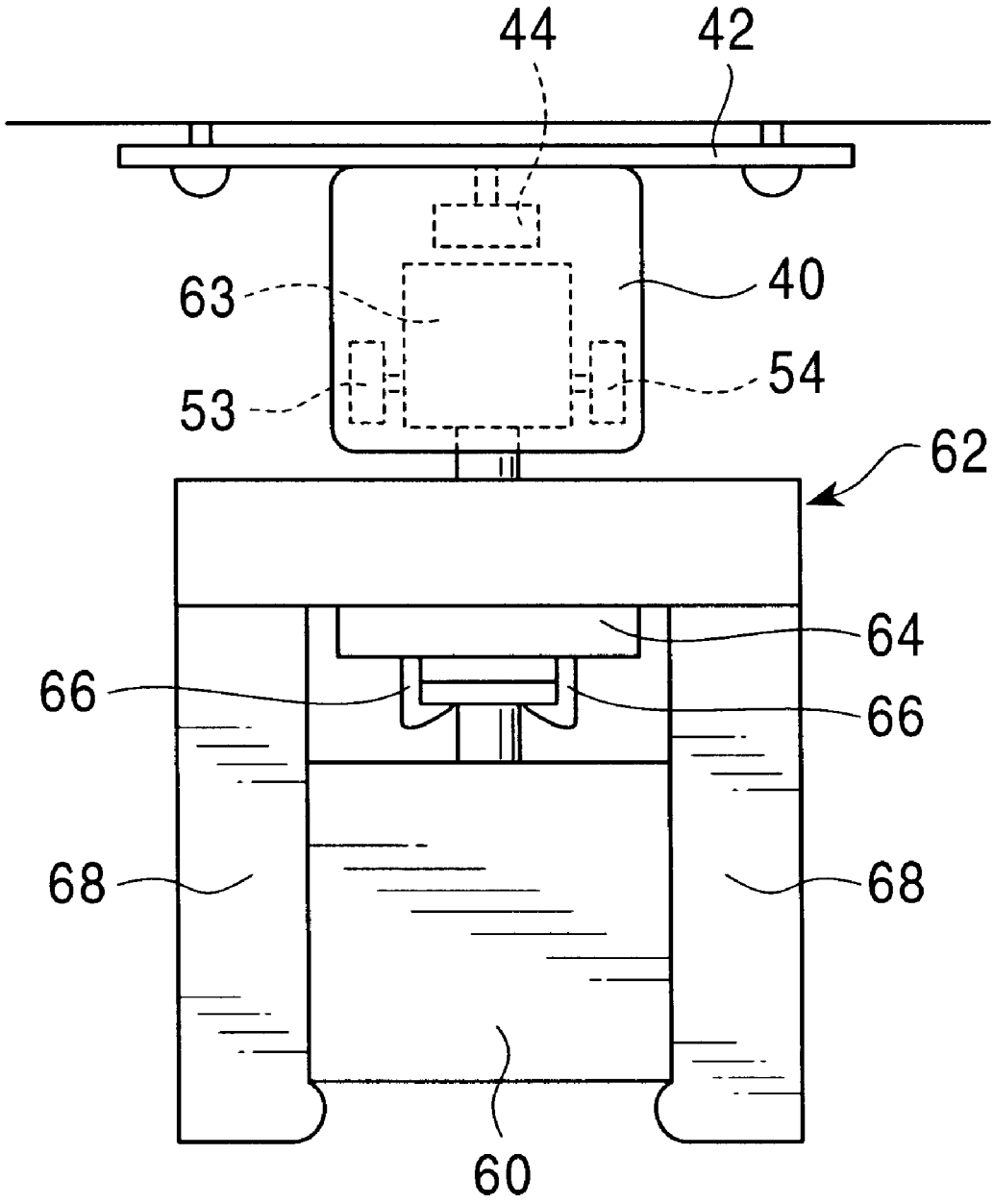
FIG. 3 is a front view showing a track guided vehicle in motion on a rail according to an embodiment of the present invention.

FIG. 2 and FIG. 3 show the common rail 40 for the linear conveyor vehicles and the track guided vehicles, which is used in the traveling loops 2,3 etc. The rail 40 is installed on the ceiling in the clean room and the like by use of a fixture 42 etc. A top surface of a bottom part of the rail 40 is used as a traveling surface, and an inner surface of a side face is used as a guide surface. Moreover, a secondary conductor part 44 is laid on a mid-upper part of the inner surface of the rail 40, the secondary conductor is laid on the bottom face and the both aspects are used as the guide surface for a diverging control.

FIG. 2 shows that a linear conveyor vehicle 50 travels along the rail 40 in a hanging condition. 51 is a traveling actuator of the linear conveyor vehicle 50, and becomes the linear motor in combination with the secondary conductor part 44, with a primary aspect of a linear motor 52. Moreover, the linear conveyor vehicle 50 is supplied electrical power, for example, in a non-contact manner from the electric supply (not shown in the drawings), for example. Traveling rollers 53,54 travel in the inner surface of aspects, following the guide by the guide roller (not shown in the drawings). By use of an articles support plate 56 and a holder 57, the linear conveyor vehicle, for example, travels so as to hold an article 60 in FIG. 2. If the vehicle stops at the station, the transfer equipment in a station side works and scoops to transfer the article 60 by the extended arm.

FIG. 3 shows that a track guided vehicle 62 travels along the rail 40 in a hanging condition. The track guided vehicle 62, which is provided with a traveling actuator 63, activates a traveling motor by supplied electrical power such as the non-contact feeding and the like from the electric supply (not shown in the drawings), and travels by the traveling rollers 53,54. Moreover, apart from this, the track guided vehicle, which is provided with guide rollers, guides on the inner surface of the aspects of the rail 40. There is not so much difference between the traveling mechanisms of the linear conveyor vehicle 50 and the track guided vehicle 62, except that the secondary conductor of the rail 40 is used or not. The track guided vehicle 62, which is provided with a hoisting part 64 and a chuck 66, makes the hoisting part 64 move up and down, and the chuck 66 grips the upper part of the article 60 to stabilize the article 60 by narrowing the width of a part 68. As the track guided vehicle has the hoisting part 64 and the chuck 66, the article 60 is possible to be transferred directly from the station of processing equipment to the station of other processing equipment or the station of stocker. The track guided vehicle 62 not only grips the article 60 by the chuck, but also holds the bottom face of the article 60 by use of the freely hoisting claw and the like.

Figure 4:
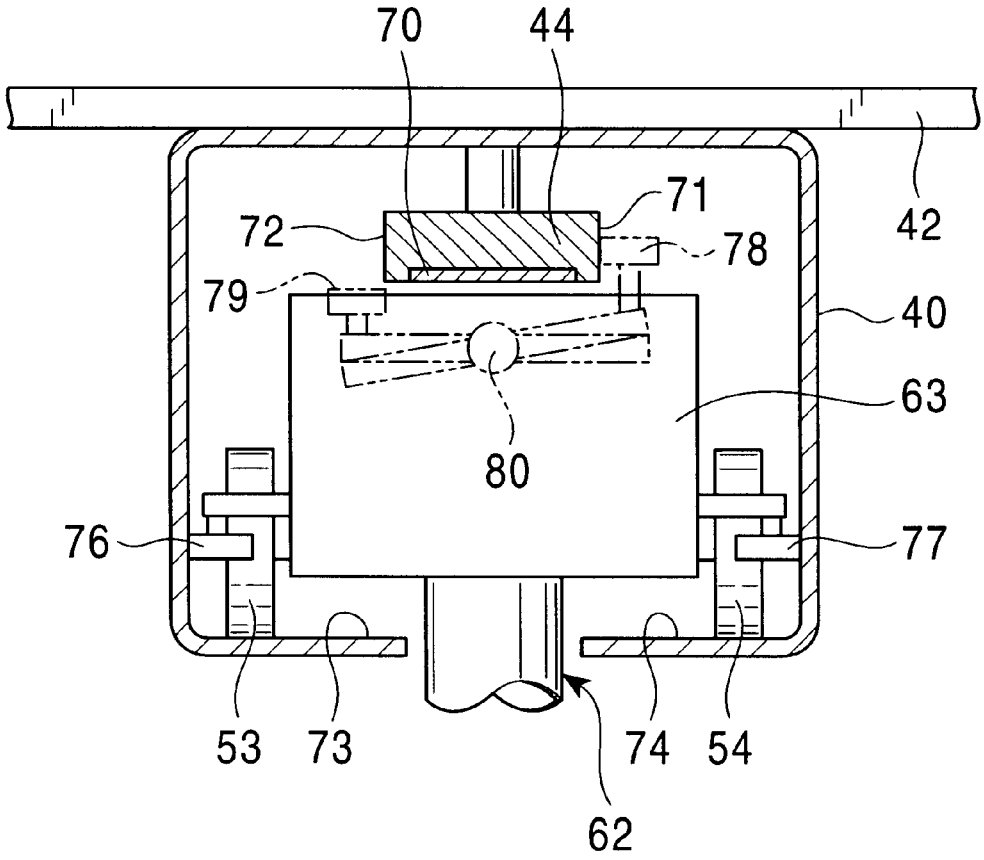
FIG. 4 is a front view showing a rail and a track guided vehicle, and shows the work of a retractable guide roller at a converging/diverging part.

FIG. 4 shows the traveling track guided vehicle 62 in the rail 40 in a vicinity of a converging/diverging part. 70 is the secondary conductor which is placed on the bottom surface of the secondary conductor part 44, both sides of the secondary conductor part 44 is used as guide surfaces 71,72 for a diverging control. Moreover, the top surface of the bottom part of the rail 40 is used as traveling surfaces 73,74. FIG. 4 shows the track guided vehicle 62 which is about to travel just before the part of the traveling surface 73 cut for the converging/diverging part, for example.

The track guided vehicle 62 is provided with guide rollers 76,77 and guide rollers 78,79 which are possible to make the state of the guide surfaces 71,72 change from contact to non-contact. A switching motor 80 makes the guide roller 78,79 move up and down and change over the contact to the guide surfaces 71,72. Moreover, the switching motor 80 changes over the height of guide rollers 78,79 between the status that either the guide roller 78 or the guide roller 79 is guided on the guide surface 71,72 and the status that both are non-contact to the guide surfaces 71,72.

In case of traveling other than the converging/diverging part, the traveling rollers 53,54 travel on the traveling surfaces 73,74 and the traveling surfaces 73,74 support the weight of the track guided vehicle 62. Furthermore, the posture of the track guided vehicle 62 is supported by the guide rollers 76,77. In the converging/diverging part, on the contrary, the place to cut the traveling surfaces 73,74 is produced. In FIG. 4, the traveling surface 73 is cut. In FIG. 4, the moment, which makes the track guided vehicle 62 slant to the counter-clockwise direction, works. Against this moment, the switching motor 80 brings the guide roller 78 into contact with the guide surface 71, and the posture of the track guided vehicle 62 is prevented from slanting. Furthermore, either the guide roller 78 or the guide roller 79 is contacted to the guide surface 71 or the guide surface 72, and the diverging direction is controlled. Furthermore, the switching motor 80 is possible to change to the voluntary mechanism in order that the guide rollers 78,79 is contacted or non-contacted to the guide surfaces 71,72.

Figure 5:
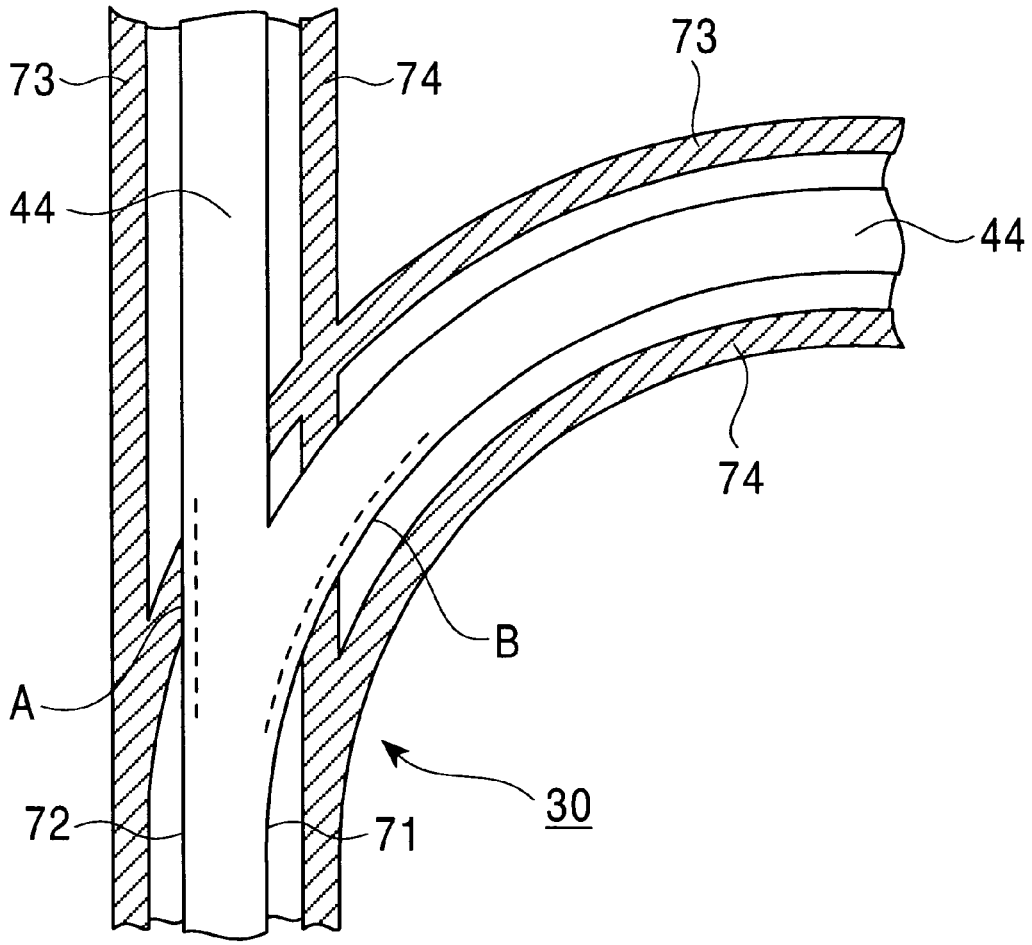
FIG. 5 shows a typical bottom face of a rail at the converging/diverging part.

FIG. 5 shows a typical aspect of the rail 40 from the bottom face side. The secondary conductor part 44 is provided between the traveling surface 73 and the traveling surface 74, and the guide surfaces 71,72 are laid on the both sides. The guide rollers 78,79 are guided in the areas A, B which is shown by the broken lines in the guide surfaces 71,72, and the track guided vehicle is prevented from slanting. Moreover, FIG. 4 and FIG. 5 show the track guided vehicle 62 travel. However, as is the case with a linear conveyor vehicle traveling, other than using the secondary conductor 70 is quite same. Furthermore, when converging as well as diverging, the slanting of the vehicle is prevented by using the guide rollers 78,79 in the interval which the traveling surfaces 73,74 is cut.

Back to FIG. 1, the operation of an embodiment is shown. There are two kinds of article conveyance, that is, the interbay transportation and the intrabay transportation. A linear conveyor vehicle which is not provided with transfer equipment is suitable for the interbay transportation, as articles are only conveyed from the outlet-side stocker to the inlet-side stocker in the process and the number of the stations for transferring articles is confined. The track guided vehicle which is provided with the transfer equipment is suitable for the interbay transportation as articles are received from the inlet stocker in the process, and the sequential articles conveyance to each station of a plurality of the intrabay processing equipment is needed.

In an embodiment, as the track guided vehicle with the transfer equipment is possible to travel on the traveling loops 2,3 of the linear conveyor vehicle, articles can be sent directly by the track guided vehicle, for example, the interbay transportation from the station of a processing equipment which is positioned in the traveling loop 23 to the station of the processing equipment which is positioned in the adjacent traveling loop 22. Contrary to this, in the conventional embodiment that the track guided vehicle is not possible to travel on the traveling loops 2,3, the articles are transferred from the traveling loop 23 to the outlet-side stocker, and from the stocker to the inlet-side stocker.

Moreover, transferring articles from a linear conveyor vehicle to the inlet-side stocker of the traveling loop 22 and transferring articles from the inlet-side stocker of the traveling loop 22 to the track guided vehicle are essential. Due to this, a total of 4-time transfers are needed on the way, and it is not efficient. In the embodiment contrary to this, as a track guided vehicle is possible to travel on the traveling loops 2,3 etc. for the linear conveyor vehicle, in case that a traveling distance of a traveling rail for the interbay transportation is short, the track guided vehicle for the intrabay transportation is capable of conveying articles directly even between processes, and the conveyance time can be shorten.

Apart from this, the necessity often arises that the particular article is conveyed to the other process in a rush. In this case, according to this embodiment, as there is no need to transfer the article between a track guided vehicle and a linear conveyor vehicle, and the rush article can be conveyed in a short period of time. Moreover, in case that the capacity of the intermediate stocker 34 at the point of transferring articles between the linear conveyor vehicle and the track guided vehicle is limited, there is no need to go through the stocker 34 as the track guided vehicle is used in the interbay transportation directly. This is effective in case that there is no extra capacity in the stocker 34 and that something is wrong with the station and the like.

A plurality of the diverging/converging parts 30 are needed to provide, as the traveling loops 20~25 are connected to the traveling loops 2,3, and the short-cuts 4~7 and the access routes 8~11 etc. are provided. It is necessary to monitor the position and the destination of a plurality of vehicles accurately at all times as controlled according to the destination of vehicle passing through the diverging/converging part 30, and the equipment is overloaded as the number of the diverging/converging part 30 is large. In the embodiment contrary to this, as the mechanism to control the diverging direction is provided on the side of the track guided vehicle 62 etc. as in FIG. 4, the load on the equipment and the control is not so much in case that a plurality of the diverging/converging part 30 is provided.

The short-cuts 4~7 is possible to make the traveling distance in the traveling loops 2,3 as well as the traveling distance between the traveling loops 20~25 and the traveling loops 20~25 shorten. For example, in case that the article are conveyed from the traveling loop 22 to the traveling loop 25 in the interbay transportation, the article passes through the short-cut 5 goes to the traveling loop 25. Furthermore, as the traveling loops 2,3 for long-distance conveyance are connected to the access routes 8~11, the article are conveyed directly in a wide range. Moreover, as the sidings 12~15 are laid, it becomes easier to transfer articles to and from the large stocker 32 and to overtake.

In the embodiment, articles are conveyed efficiently as the conveyance system for the intrabay and the interbay transportation are integrated. Moreover, the carrying system is also capable of applying to the other assembling plants or waste units and the like, though the embodiment shows the application for the clean room.

In the embodiment, as the conveyor vehicle for the intrabay transportation is possible to travel the conveyance route for the interbay transportation, the rush articles and the like can be conveyed directly by way of the conveyance route for interbay transportation.

Furthermore, in the embodiment, as both the linear conveyor vehicles and the track guided vehicle travel in a hanging condition, the dead space covered by the carrying system is small.

Furthermore, the vehicle supports their own weight by the top surface of the bottom part of the rail used as the traveling surface, keeps the posture of vehicle by the aspect of the inner surface of the rail used as the guide surface, and the secondary conductor laid on the upper part of the inner surface of the rail makes the linear conveyor vehicle travel. Besides, the guide surfaces of the both side surface keeps the posture of the vehicle when diverging, and the diverging direction is controlled. Also, in the embodiment, as the intrabay transportation and the interbay transportation are integrated, the capacity of the stocker which can be used as these buffer can be small.

What is claimed is:

1. A carrying system in which a conveyor vehicle for interbay transportation runs along along-distance loop for interbay transportation and in which a plurality of short-distance loops for intrabay transportation are provided around said long-distance loop so that a conveyor vehicle for intrabay transportation can run along said short-distance loops, the system comprising short-distance loops connected to a long-distance loop, and a loading device mounted on a conveyor vehicle for intrabay transportation so that the conveyor vehicle for intrabay transportation can convey articles from one of the short-distance loops through said long-distance loop to another short-distance loop.

2. The carrying system according to claim 1, wherein said conveyor vehicle for interbay transportation and said conveyor vehicle for intrabay transportation are each provided with means for controlling a diverging direction in a diverging/converging part.

* * * * *